United States Patent [19]

Frentzel et al.

[11] 4,306,608

[45] Dec. 22, 1981

[54] LOUVER CARRIER FOR LOUVER OF A VERTICAL VENETIAN BLIND

[76] Inventors: Kurt H. Frentzel, Schoolstraat 21, Zevenhoven, Netherlands; Herman Oskam, Vlisterdijk 14, Bergambacht, Netherlands

[21] Appl. No.: 136,995

[22] Filed: Apr. 3, 1980

[30] Foreign Application Priority Data

Apr. 6, 1979 [DE] Fed. Rep. of Germany ..... 2913885

[51] Int. Cl.[3] ..... E06B 9/26

[52] U.S. Cl. ..... 160/176 R; 160/177

[58] Field of Search ..... 160/176 R, 177, 174, 160/175, 166 A, 168 R, 173, 178 R; 64/30 E

[56] References Cited

U.S. PATENT DOCUMENTS 3,996,988 12/1976 de Wit ..... 160/176 R X 4,103,727 8/1978 Spohr ..... 160/168 R

*Primary Examiner*—Philip C. Kannan

*Attorney, Agent, or Firm*—Pennie & Edmonds

[57] ABSTRACT

A carrier for a louver of a vertical venetian blind is disclosed for supporting a louver for rotation about its vertical axis and for transport along the headrail, which carrier includes a drive mechanism for rotating the louver about its vertical axis. The drive mechanism is disclosed as including a worm and a gear arrangement with a slip clutch disposed between the worm and the drive shaft. In one embodiment, the slip clutch comprises a slotted sleeve mounted on the drive shaft inside the hub of the worm, which sleeve has lugs positioned to engage a stop on the gear to effect the opening of its slot and reduction of its frictional contact with the drive shaft. In second embodiment, the worm itself frictionally engages about the guide shaft and has a slot along its length with the ends of the slot receiving wedge-like cams integral with rings loosely mounted on the drive shaft. Upon one carrier striking an adjacent carrier, the wedge-like cams widen the slot in the worm hub, thus reducing its frictional engagement with the drive shaft.

15 Claims, 9 Drawing Figures

10
10a
12
12'
15
16
20
35
36
36a
36b
37
38
39
40
40'
41
42
43
43a

LOUVER CARRIER FOR LOUVER OF A VERTICAL VENETIAN BLIND

BACKGROUND OF THE INVENTION

1. Field of the Invention

This invention relates to venetian blinds and, in particular, to vertically arranged venetian blinds in which a plurality of elongated louvers are arranged vertically and are supported from the upper end by a louver carrier which, in turn, is supported by a headrail. In blinds of this type, means must be provided for traversing the carriers and their supported louvers along the rail to open and close the blind. Means must also be provided for rotating the louvers about their individual vertical axes. In many blinds of this type a separate means, such as a drive shaft, cord or chain, is provided for the traversing function and a second such drive is provided for the rotating function. In other blinds of this type, particularly in recent years, a single operating means has been provided to perform both the traversing and the rotating function. It is to this single operating mechanism-type of blind to which the present invention is particularly directed.

2. Prior Art

In the type of vertical venetian blind in which a single operating mechanism such as a drive shaft is used for both functions (traversing the blind and rotating the louvers) a disengagement or decoupling between the louver and the turning shaft must take place at the end of the turning range, at least to an extent sufficient to permit the drive shaft to rotate beyond that point in order to traverse the louvers to open or closed position of the blind. Heretofore, this decoupling of the louvers from the rotation of the drive shaft has involved very high engineering expenditure and complex slip clutches. Additionally, extensive wear of the slip clutches has been experienced due to the fact that even when slipping (decoupled) a considerable frictional force is still applied to the drive shaft, thus requiring a proportional increase in the input power to rotate the shaft.

Moreover, prior art devices have generally suffered from the problem that when rotating the louvers to adjusted position, there may remain a tendency to continue the transport of the carrier along the rail.

SUMMARY OF THE INVENTION

The present invention is directed to a mechanism for supporting a louver of a venetian blind vertically from one end for rotation about its axis and for transport along the rail in which a very economical means is provided for coupling and decoupling the gear which rotates the louver from the drive shaft. The construction is such that any frictional force still applied to the drive shaft when the gear is decoupled is minimized during transport of the carrier. The structure is also such as to guard against transport of the carrier along the rail when the drive shaft is coupled to the gear to rotate the louver.

To this end, the invention utilizes a slip clutch in which one of the two friction surfaces is the outer circumferential surface of the drive shaft while the mating friction surface is the inner surface of a sleeve surrounding and embracing the drive shaft. On its outer surface, the sleeve carries a worm which transmits the rotation of the drive shaft and the sleeve to a gear which, in turn, is connected to the louver to rotate the same. In order to decouple the sleeve from the drive shaft, the sleeve is slotted throughout at least a portion of its length, and preferably throughout its entire length, so that it may be opened to reduce the frictional engagement with the drive shaft. This opening of the sleeve may be accomplished in various ways. Disclosed herein are two embodiments of the invention in each of which the opening is accomplished somewhat differently.

In the first embodiment of the invention, the worm is on a hub which is placed over the sleeve, which hub has a slot in alignment with and generally somewhat wider in the circumferential direction than the slot in the sleeve. A small lug extends outwardly from each edge of the slot in the sleeve and passes through the slot in the hub. Each of these lugs is generally in alignment with one of the two ends of the worm. The gear which cooperates with the worm and which is driven thereby and which, in turn, rotates the louver has a stop or stops provided between adjacent teeth. When the drive shaft is driven, it is frictionally engaged by the sleeve which, in turn, drives the hub and worm in large part due to the engagement of one of the lugs with its associated end of the worm. Upon continued rotation, the other lug aligned with the other end of the worm comes up against the stop on the gear, continued rotation of the drive shaft tends to open the slot in the sleeve wider against the natural resiliency of the sleeve, if any, and against a spring surrounding the sleeve, if such is provided. Thus, the drive shaft becomes effectively decoupled from the worm gear and the gear that supports and rotates the louver. However, promptly upon rotation of the drive shaft in the opposite direction, the same frictional engagement of the sleeve with the outer surface of the drive shaft will be instantly re-established and rotation of the louver in the opposite direction may be accomplished.

In the second embodiment, the worm is arranged directly on the outer surface of the sleeve and may be integral therewith. The opening of the sleeve is accomplished by a ring at each end thereof, which rings surround the drive shaft loosely. Each of the rings has a lug-shaped tooth engaged in the end of the sleeve slot. Each of the rings also engages in sliding relationship with the inner surface of opposite vertical walls of the carrier. In the normal position, the teeth of these rings are only partially inserted into the ends of the sleeve slot; however, when another carrier (which may be a pull carrier or another louver carrier) bears against the outer wall of the carrier, it flexes the wall and moves one of the rings axially of the drive shaft, thus forcing the lug-shaped tooth of the ring further into the slot in the sleeve, thus widening the slot and expanding the sleeve to decouple the same from the drive shaft. When the traversing pressure of the adjacent carrier is then relieved, the carrier wall will assume its normal position and permit the ring to assume its normal position, with the sleeve again frictionally and drivingly engaged with the drive shaft.

All of the several parts of the carrier and gear mechanism are preferably injection molded plastic with some inherent resiliency. The drive shaft and spring is preferably of metal.

DETAILED DESCRIPTION OF THE INVENTION

General Description of the Blind

Figure 1:
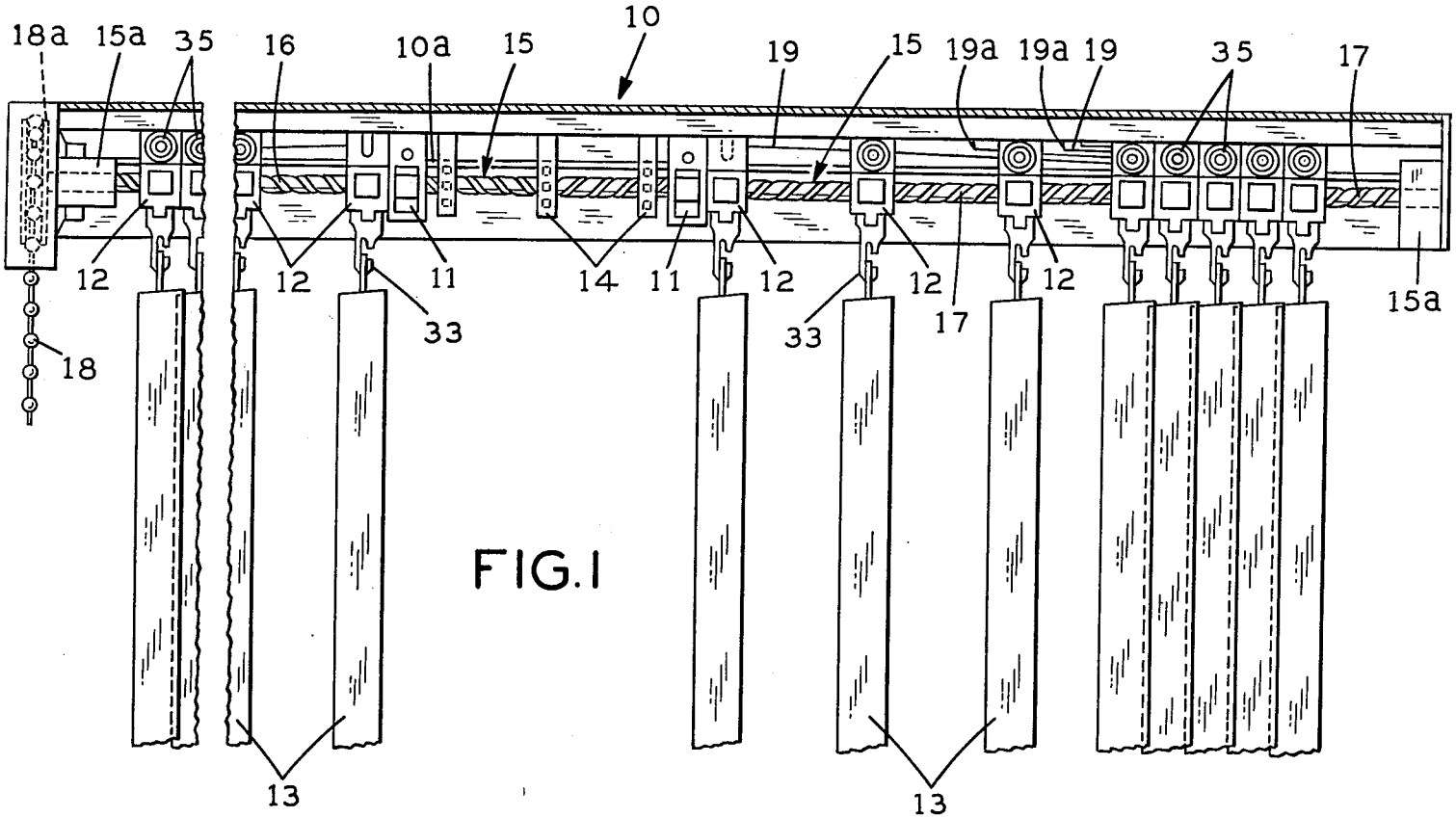
FIG. 1 shows a side view of a vertical louver venetian blind with portions of the headrail in cross-section.

As shown in FIG. 1, the vertical louver venetian blind comprises a head rail 10 having on either side thereof on the inner side of the walls spaced tracks 10*a*, only one of which is shown in FIG. 1. Supported from these tracks 10*a* by rollers 35 are a plurality of carriers 12, each of which carries a louver 13 suspended therefrom by a louver holder or hook 33 extending downwardly from a louver holding pin 32 (see FIG. 4) mounted for rotation in the carrier 12.

As is most commonly utilized in practice, the louvers 13 and their associated carriers 12 are arranged in two packs, one to the left and one to the right which, when the blind is closed, meet at the center and, when the blind is open, are packed together in two packs, one at the left end and one at the right end of the rail 10.

A drive shaft 15 is mounted within the head rail 10 by means of bearing blocks 15*a* at or adjacent the ends of the shaft 15 and also by means of intermediate supports 14 through which the drive shaft 15 extends. The intermediate supports 14 are provided in order to prevent any sagging of the drive shaft 15. Depending upon the length of the head rail 10, the intermediate supports 14 may be fixed relative to the rail 10 or, alternatively, may themselves be designed to be traversed along the length of the drive shaft in order to provide strength where needed. In this latter case, they would be constructed similarly to the carriers 12, in that they would have members supported upon the tracks 10*a*. The drive shaft 15 also extends through a pair of pull carriers 11, one of which is associated with each of the two packs of carriers 12. The drive shaft 15 has three helical grooves. The grooves 16 on one-half of the shaft 15 are opposite to the grooves 17 on the other half of the drive shaft 15. Each of the pull carriers 11 has within its means (not shown) for engaging the three helical grooves 16 or 17 in the drive shaft 15 for sliding engagement along the drive shaft upon rotation thereof. As will be apparent from FIG. 1, upon rotation of the drive shaft 15, one of the pull carriers 11 (the one to the right in the figure) will move to the right away from the other pull carrier 11 (the one to the left) which will move to the left due to the different and opposite direction of the three helical grooves 16 with respect to the three helical grooves 17. Each of the pull carriers 11 is also connected securely to the first adjacent carrier 12 of its associated pack of carriers 12. Accordingly, when the pull carriers 11 move from the center toward the ends of the headrail 10, they will carry with them the first associated carrier in each pack until they reach the next carrier, at which point they will carry both the first and second carrier 12 along with them until they reach the third carrier 12 and move it along as well and so on, picking up each carrier in succession and moving it toward the end. When the drive shaft 15 is driven in the opposite direction, the pull carrier 11 and the first louver carrier 12 to which it is secured will be moved from the end position toward the center position. When pull carrier 11 and its connected louver carrier 12 have moved together toward the center a predetermined distance, the carrier 12 will engage the stop 19*a* of a spacer member 19. Each of the louver carriers 12, except for the first ones which are connected to the pull carrier 11, has secured thereto at one end an elongated metal strip 19 which extends to and through the next adjacent louver carrier 12 toward the center. This elongated metal spacer strip 19 determines the spacing between adjacent louver carriers 12 and, thus, between the louvers 13. The spacer 19 extends through in sliding relationship with the next adjacent carrier 12 that is on that side toward the center. When a carrier 12 reaches the end of the spacer 19, it engages the up-turned stop 19*a* and, thus, pulls the next succeeding carrier 12 along, which next succeeding carrier 12 is fixed to the opposite end (opposite end 19*a*) of the spacer member 19. In this way, the blind, when closed, insures that the individual louvers 13 are evenly spaced while at the same time permitting them to pack together at the ends when opened.

At one end of the shaft 15 is a bead chain pulley 18*a* secured thereto and around which is engaged a bead chain 18 for operating the blind by rotating the drive shaft 15.

First Embodiment of Louver Carrier

FIGS. 2 through 5 show a first embodiment of a louver carrier and turning drive in accordance with the invention. As shown therein, the louver carrier 12 comprises a casing 20 through which the drive shaft 15 extends. A sleeve 21 is frictionally engaged about the drive shaft 15 and carries on its outer surface a worm 27 having a worm thread 29 which engages a gear wheel 31 which supports a pin 32 (see FIG. 4), having on its lower end a louver support hook 33 for supporting a louver 13.

Figure 2:
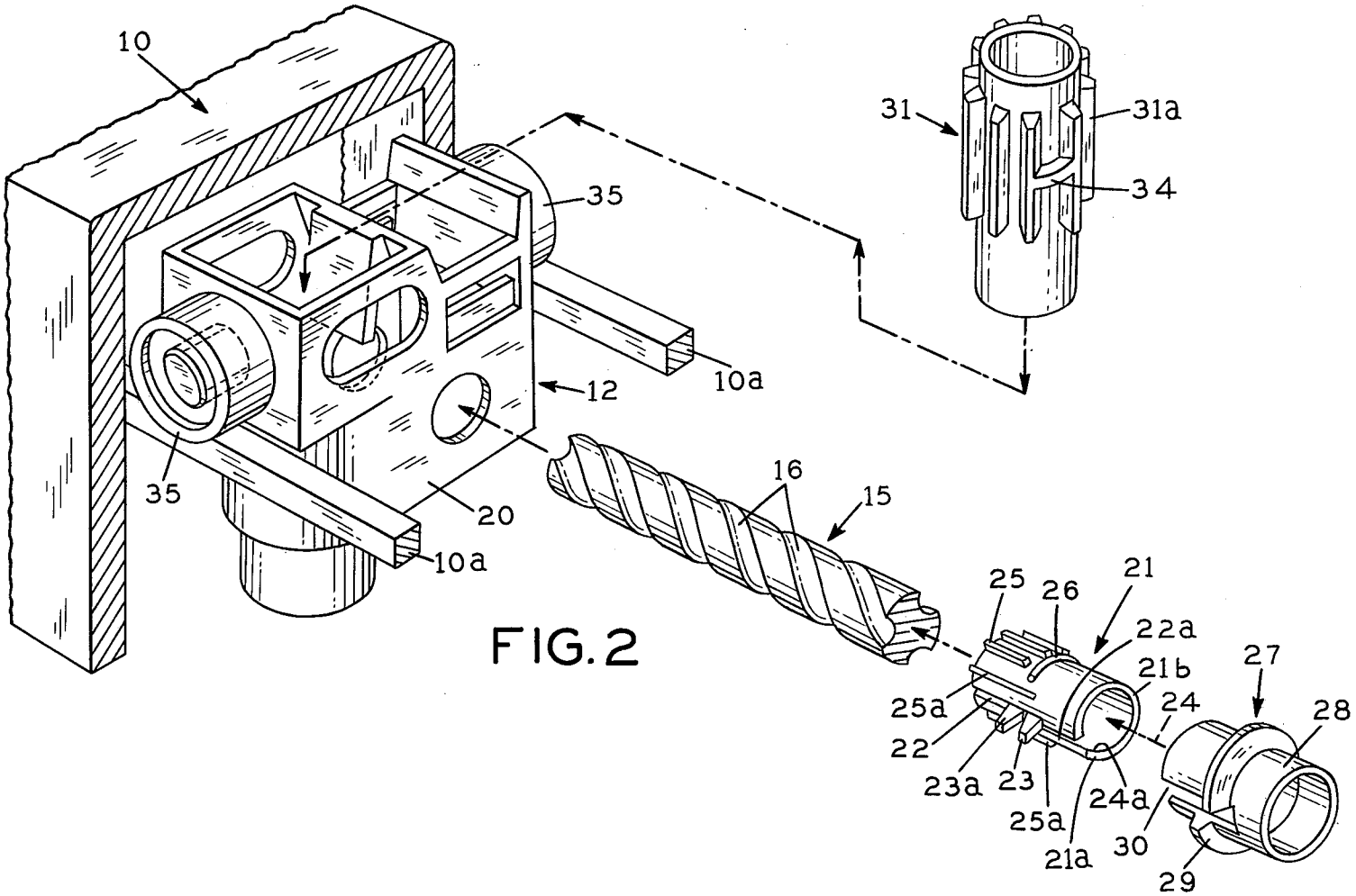
FIG. 2 shows in an exploded view the components of a louver carrier including the turning drive, all in accordance with the first embodiment of the invention.
Figure 3:
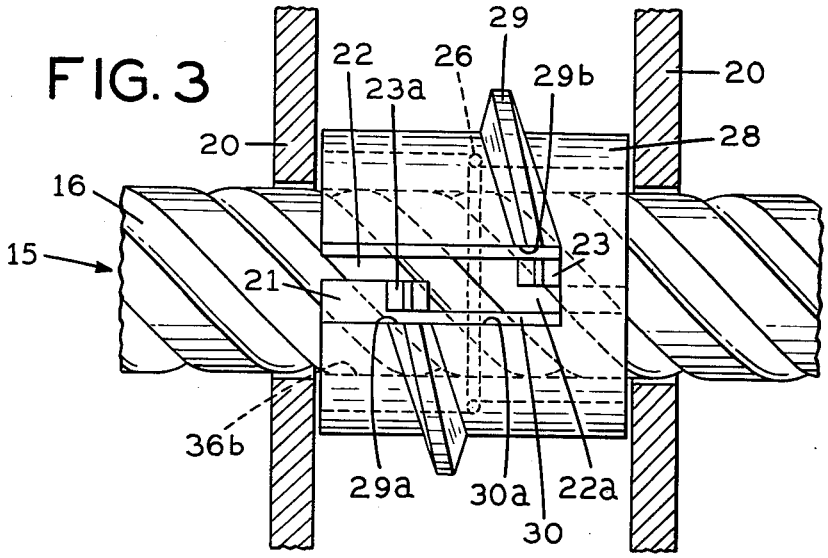
FIG. 3 shows a cross-section through a portion of the carrier of FIG. 2 with the drive mechanism shown in elevation in coupled relationship.

Having reference now, particularly, to FIGS. 2 and 3, it will be seen that the sleeve 21 has its wall slit throughout the length thereof by two slots 22, 22*a*. The two slots 22, 22*a* are offset from each other slightly in the circumferential direction of the sleeve 21. The slots 22, 22*a* extend inwardly from their respective ends toward the center where they communicate with each other, as shown in FIG. 3. Beginning at the inner end of each slot 22, 22*a* and extending therebeyond, the sleeve has a pair of outwardly extending generally triangular-shaped lugs 22, 23*a* for purposes which will hereinafter become apparent. The wall 21*a* of the sleeve 21 is, in the area 21*b*, diametrically opposite to the slots 22, 22*a* and is of substantially thinner construction than elsewhere. Accordingly, the external circumferential surface of the sleeve 21 is eccentric in relation to the central axis 24 of the opening 24*a* in the sleeve 21. This thinner portion 21*b* of the wall 21*a* is weaker than the remaining portion of the wall 21*a*, so that the sleeve 21 may be slightly expanded by separating the opposite edges defining the slots 22, 22*a*, thus reducing the frictional engagement of the inner surface of the bore 24*a* with the outer surface of the drive shaft 15 in a manner described below.

Figure 4:
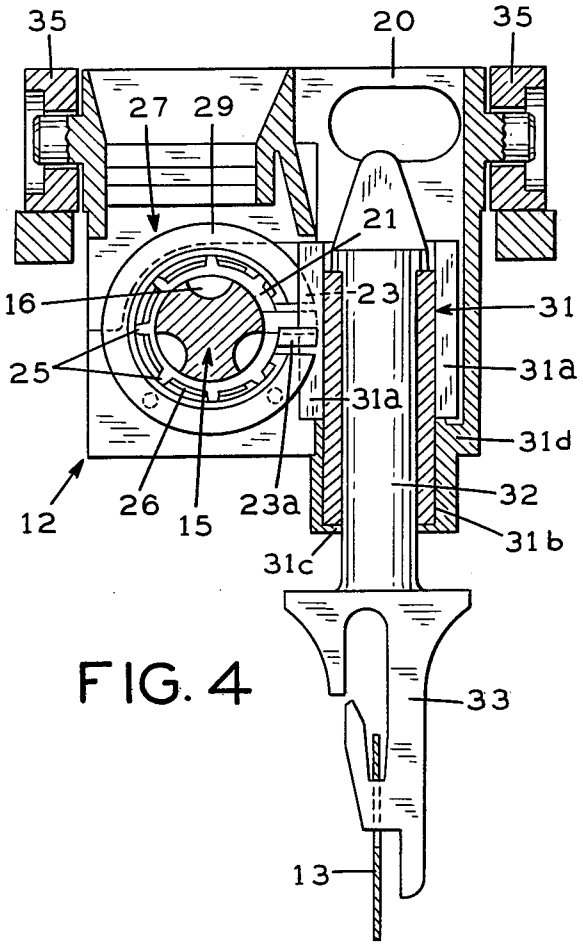
FIG. 4 shows a cross-section through the carrier taken along the line IV—IV in FIG. 5.
Figure 5:
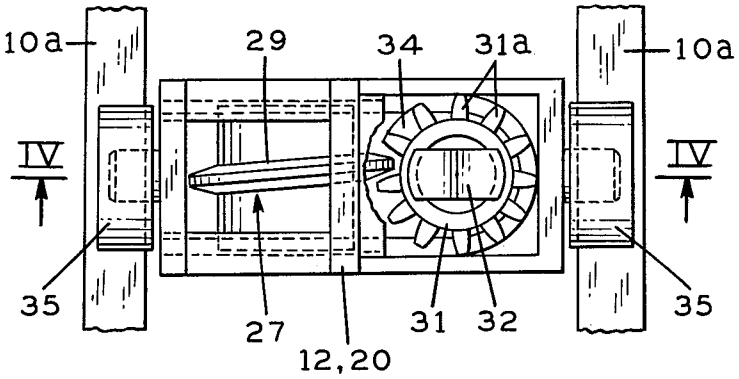
FIG. 5 shows a top plan view of the carrier of FIG. 2.

On its outer surface, sleeve 21 has guide strips 25, 25*a*. The height of the guide strips 25, 25*a* varies for each such guide strip in such a way that a surface of revolution taken to coincide with all of the outer tops of the guide strips 25, 25*a* scribes a cylinder having its axis coinciding with the axis 24. Stated another way, the tallest guide strip 25 is at the thinest point 21*b* of the wall 21*a* with the heights of the other strips 25 becoming gradually shorter as one travels from the thin area 21*b* toward the slots 22, 22*a* in either direction. In effect, the guide ridges 25 re-establish a concentric outer surface for the sleeve 21 in order to fit concentrically within the hub 28 of the worm 27. The guide ridges 25*a* which are closest to the slot 22 on either side thereof are elongated axially in order to limit the motion of a spring 26 which surrounds most of the sleeve 21. Thus, the guide, ridges 25*a* prevent the spring 26 from moving about the sleeve 21 and possibly overlapping the slot 22. The spring 26 may be of steel wire and serves to compress those parts of the sleeve 21 on either side of the thin wall zone 21*b* so that the sleeve 21 frictionally engages the external surface of the drive shaft 15. A worm 27 has a worm thread 29 and a hub 28, which hub 28 surrounds and is in engagement with the sleeve 21 and, in particular, the outer ends of the ridges 25, 25*a*. The hub 28 is provided with a notch 30 through which passes the lugs 23, 23*a* of the sleeve 21. As shown in FIG. 3, the notch 30 is of greater width in the circumferential direction than the combined width of the slots 22, 22*a* taken in the same direction. The lugs 23, 23*a* each line up with one of the two ends of the worm thread 29, as shown in FIG. 3. That is, each of the lugs 23, 23*a* is in generally the same radial plane as its associated end of the worm thread 29. As shown in FIG. 4, worm thread 29 on the worm gear 27 engages the teeth 31*a* of a gear wheel 31 supported in a bore 31*b* in the casing 20. The gear 31 is mounted for rotation within the bore 31*b* and is in part supported by an annular flange 31*c* and in part supported by an annular ridge 31*d*.

Operation

In operation, when the drive shaft is rotated by means of the bead chain 18 and pulley 18*a* in either direction, the louvers 13 are first turned about their individual axes until they reach the limit of their rotation in that direction. It will be apparent that in the event the louvers are already at the limit of their movement in the direction of the force applied, then, in the event, no further movement will take place. During this rotation of the louver, means (not shown) within the pull carrier 11 prevent its transport along the drive shaft 15. However, once the louvers have been turned by the shaft 15 to the limit of their rotation about their vertical axes, the slip clutch 21 opens as described below, thus reducing to a minimum its frictional contact with the drive shaft 15. Shortly after this, the pull carrier 11 will begin to transport along the rail 10 carrying with it the first louver carrier 12 and picking up each successive louver carrier 12 until they are packed together at one end or until the force applied by the bead chain 18 is stopped.

Figure 3A:
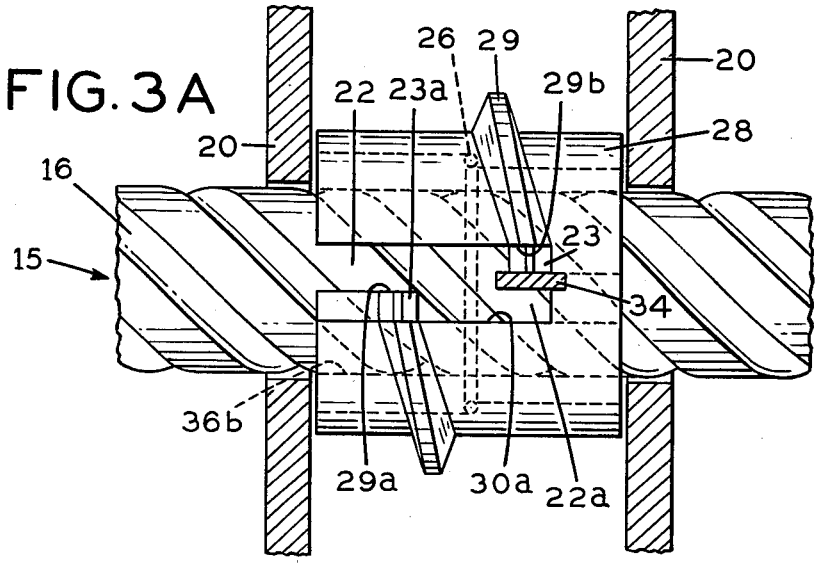
FIG. 3A is a view like FIG. 3 showing the sleeve expanded to decouple it from the drive shaft.

During the rotation of the louvers 13 about their vertical axes, the frictional engagement between the sleeve 21 and the drive shaft 15 causes the sleeve 21 to rotate with the drive shaft. Also, either the lug 23 or the lug 23*a* (depending upon which direction of rotation the sleeve is moving) comes up against one of the edges of the notch 30 and one end of the worm thread 29, and thus carries the worm gear 27 with it in the same direction of rotation. For example, having reference to FIG. 3, if the drive shaft 15 is turning toward the viewer from the top (i.e. clockwise as viewed in FIG. 4), the lug 23*a* comes up against the end 29*a* of the worm thread 29 which is in the same plane as the edge 30*a* of the notch 30. This contact between the lug 23*a* and the end 29*a* of the worm thread 29 as well as its bearing against the edge 30*a*, causes the worm gear 27 to rotate with the sleeve 21 and the drive shaft 15 and in the same direction. This rotation of the worm gear 27 also rotates gear 31 which supports the louver 13. This rotation is accomplished by the engagement of the worm thread 29 with the teeth 31*a* of the gear 31. When the louver 13 has reached the limit of its movement, the lug 23 will come into contact with the top of the stop 34 on the gear 31. The stop 34 is shown in FIG. 3A in this position, although the rest of the gear 31 is not shown in this figure. Further rotation of the shaft 15 will cause the lug 23*a* to continue to move for a very short distance; however, since the lug 23 has come up against the stop 34, the only way for the lug 23*a* to continue to move this short distance is by flexing of the sleeve 21 in its reduced wall portion 21*b*, with the result that the slots 22, 22*a* become wider. The notch 30 is sufficiently wide in the circumferential direction to permit this additional short movement. This short distance of movement of the lug 23*a* and the sleeve 21 is also imparted to the worm gear 27 until the face 29*b* of the worm thread 29 comes up against the lug 23. This condition is shown in FIG. 3A. At this point, no further movement of the sleeve 21, the lug 23*a*, or the worm gear 29 is possible; however, as long as the shaft 15 is rotated, the slots 22 and 22*a* will be maintained in their widened condition, thus enlarging the bore 24*a* sufficiently to greatly reduce the friction between the surface of the bore 24*a* and the outer surface of the drive shaft 15 to a very minimal amount. It is during the maintenance of this condition, as shown in FIG. 3A, during which the drive shaft 15 rotates but the sleeve 21 and worm gear 27 are stopped, that means (not shown) within the pull carrier 11 operates to effect transport of the pull carrier 11 along the rail 10. Transport of the pull carrier 11 and the successive louver carriers 12 is continued to the desired amount and then rotation of the shaft 15 is stopped by releasing the bead cord 18. When the rotation of the shaft 15 is stopped, the force applied to the sleeve 21 by the drive shaft 15 to widen the slots 22, 22*a* is also stopped. Accordingly, the natural resiliency of the sleeve 21 and the force of the spring 26 causes the sleeve 21 to close up again, and again embrace the drive shaft 15 which will tend to move the lug 23*a* away from the end 29*a* of the worm thread 29 to the position shown in FIG. 3. In this position, if the bead chain 18 is again grasped and rotational movement applied to the drive shaft 15, one of two things will occur, depending upon which direction the force is applied. If the force is applied in the same direction as before, i.e. downward toward the observer from the top as viewed in FIGS. 3 and 3A, then, in that event, the slots 22 and 22*a* will again promptly open up as shown in FIG. 3A and slippage will occur while at the same time further transport of the pull carrier 11 takes place. On the other hand, if at this point force is applied to the bead chain in the opposite direction, i.e. upwardly toward the observer from the bottom as viewed in FIGS. 3 and 3A, then, in that event, the drive shaft 15 carries the sleeve 21 with it until the lug 23 engages the end 29*b* of the worm thread 29, whereby to carry with the sleeve 21 the worm gear 27. This rotation of the drive shaft 15, sleeve 21, and worm gear 27 will now rotate the gear 31 and the louver 13 to the desired position. If this movement is continued to the limit of rotation in this second direction for the louvers 13, then, in that event, the lug 23*a* comes up into contact with the bottom side of the stop 34. Now the lug 23 continues to move a very slight distance carrying with it the worm gear 27 until the face 29*a* of the worm thread 29 comes up against the stop lug 23*a*, whereupon further movement again widens the slots 22 and 22*a* slightly, thus again decoupling the worm gear 27 from the drive shaft and permitting the shaft 15 to continue rotation without effecting rotation of the sleeve 21 or the worm gear 27. At this point, continued rotation of the shaft 15 effects transport of the pull carrier 11 in the direction opposite to that previously described until the pull carrier 11 either reaches its limit or the forces applied thereto by the bead cord 18 are released. When driving force is released on the drive shaft 15, the resiliency of the sleeve 21 and the force applied thereto by the spring 26 will again cause the sleeve 21 to grasp the drive shaft 15 and again assume the position shown in FIG. 3.

It will be noted that the positioning and shape of the lugs 23, 23*a* is such that they are in effect a continuation of the worm thread 29 and, thus, they in no way interfere with the worm thread 29 and its engagement with the teeth 31*a* of the gear 31.

Second Embodiment of the Louver Carrier

Figures 6, 7, 8:
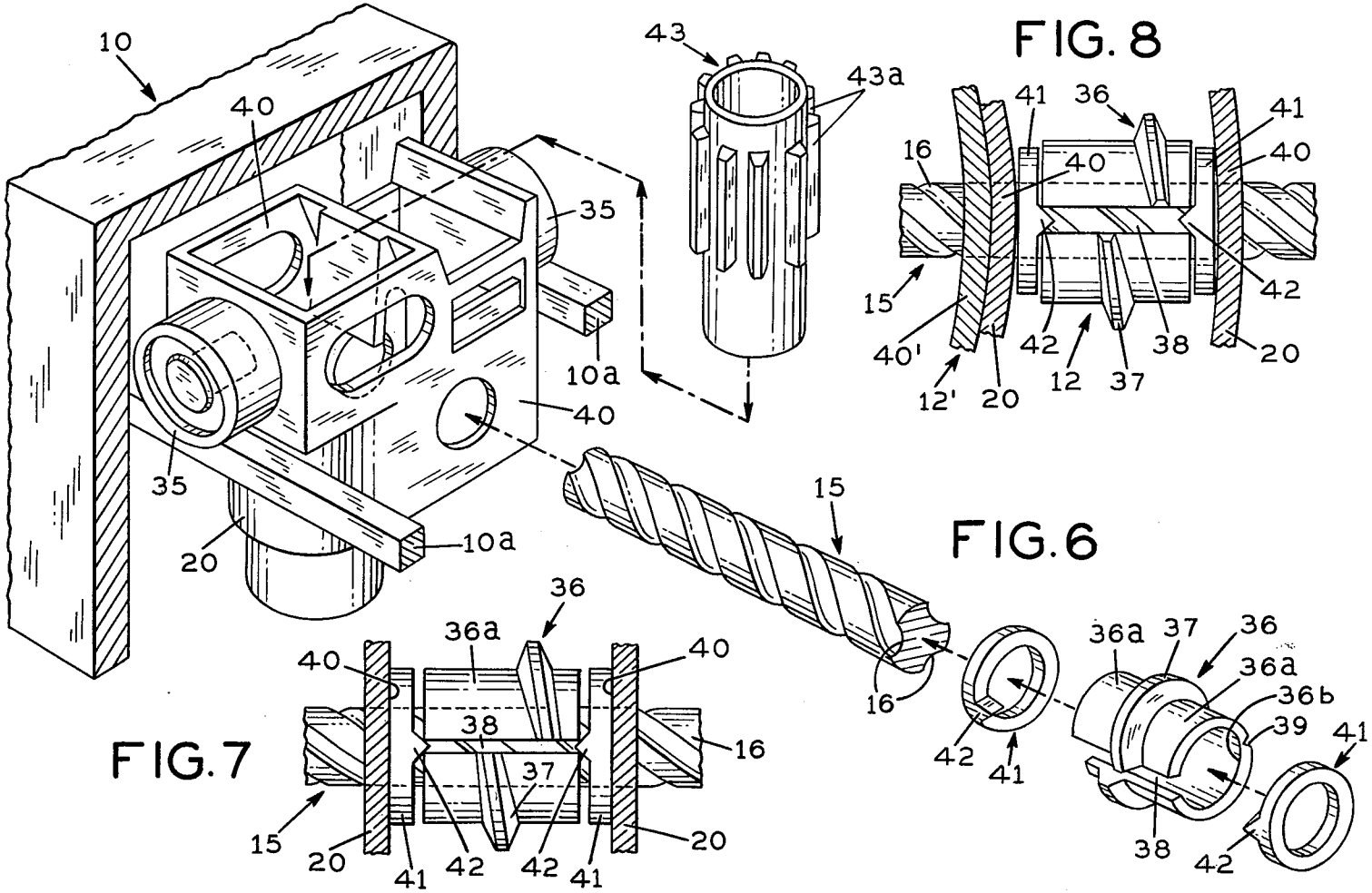
FIG. 6 is an exploded view of a carrier and turning drive of the second embodiment of the invention.
FIG. 7 is a cross-section through the carrier of FIG. 6 showing the parts in coupled relationship.
FIG. 8 is a view like FIG. 7 with the parts uncoupled.

The second embodiment of the louver carrier and rotating drive is shown in FIGS. 6, 7 and 8. As shown, the carrier 12 has the same casing 20 supported by the rollers 35 from tracks 10*a* in rail 10. Also, the drive shaft 15 extends through openings in the housing 20. In this embodiment, the worm gear 36 comprises a hub 36*a* and a worm thread 37. The wall of the worm gear 36 is slotted throughout its length at 38 and has a groove 39 diametrically opposite thereto on the outer surface thereof to weaken the same and to permit some flexing of the hub 36*a* to bring the opposite edges of the slot 38 together or, under the influence of friction applied thereto, by the drive shaft 15 to widen the slot 38. The worm gear 36, accordingly, comprises a combination slip clutch sleeve and worm gear in a single part. The worm gear is engaged about the shaft 15 with the inner surface 36*b* frictionally engaged with the outer surface of the drive shaft 15 to be driven thereby. At each end, the worm gear 36 has associated therewith a ring 41 extending loosely about the shaft 15. Each of the rings 41 has a wedge-shaped tooth 42 extending part-way into the adjacent end of the slot 38. When positioned within the housing 20, as shown in FIG. 7, and when at rest, the rings 41 are in loose sliding contact with the inner surfaces of the side walls 40 of the casing 20. Alternatively, the various parts may be so dimensioned as to provide a small space between one or both of the rings 41 and its adjacent wall segment 40. In this position, driving force applied to the drive shaft 15 in either direction will effect rotation of the worm gear 36, which is firmly frictionally engaged therewith. This rotation will also carry the rings 41 along with the worm gear 36 due to the engagement of the wedges 42 in the ends of slot 38. Rotation of the worm gear 36 is also imparted to the louver-turning gear 43 by virtue of the engagement of the worm thread 37 with the teeth 43*a* of the gear 43. In this embodiment, the gear 43 is not provided with a stop, such as the stop 34 on the gear 31. However, if the gear 43 were provided with a stop such as the stop 34, the worm gear 36 could still be used in which event the rings 41 with their teeth 42 would not be required. Also, if the gear 43 were provided with a stop 34, the opening and closing of the worm gear 36 would be effected at the end of rotational movement of the louver 13 in either direction in much the same way as in the first embodiment. It is preferred, however, in this embodiment to eliminate the stop 34 and to operate the blind somewhat differently as described below. Accordingly, the rings 41 and their wedges 42 are required.

Operation of Second Embodiment

When the bead cord 18 is operated to rotate drive shaft 15 in either direction, rotation of the drive shaft 15 will effect rotation of the worm gear 36, gear 43, and the louver 13. Unlike the first embodiment, in this embodiment, the pull carrier 11 is provided with means that transports the pull carrier during this rotation of the louvers 13 by the drive shaft 15. As long as the carrier 20 is stationary with respect to the rail 10, rotation of the louver 13 will continue; however, when the pull carrier or an adjacent louver carrier 12 comes up against one of the carriers 12, rotation will be stopped in a manner now to be described.

As shown in FIG. 8, there is a first carrier 12 against which a second carrier 12′ has now come in contact from the left. The walls 40, 40′ of the carriers 12, 12′ have a given degree of flexibility which causes them to flex inward or outward as the case may be as shown in FIG. 8, when contacted on their outer surface by another carrier 12. This inward flexing of the wall 40 is sufficient to press the adjacent ring 41 axially along the drive shaft 15 toward the worm gear 36. This axial movement of the ring 41 causes the wedge-shaped tooth 42 to be driven deeper into the slot 38, thus separating the edges of the slot and enlarging the opening within the hub 36*a*, whereupon further rotation of the worm gear 36 will not take place. As shown in FIG. 8, the carrier 12′ has approached from the left and has effected an inward flexing of the left-hand wall 40 of the carrier 12, thus moving the ring 41 adjacent thereto toward the right and spreading the slot 38 wider due to the wedge-shaped tooth 42. As the slot 38 is forced wider by the left-hand tooth 42, the worm gear 36 will move to the right and at its right-hand end, the slot 38 will accept more and more of the right-hand tooth 42. It will be appreciated that the inward flexing of the left-hand wall 40 of the carrier 12 may be fully compensated for by this movement of the teeth 42 deeper into the slot 38. To the extent the inward flexing of the wall 40 on the left is not fully compensated for in this manner, the right-hand wall 40 may flex slightly, although to a lesser extent than the left-hand wall since most of the movement of the left-hand wall has been compensated for by the deeper insertion of the teeth 42 in the slot 38. In FIG. 8, this flexing of the wall 40′ and left-hand and right-hand walls 40 is illustrated with some exaggeration for clarity.

If the blind had been traversed in the opposite direction, a different carrier 12 would have approached from the right and effected the decoupling by flexing the right-hand wall 40 inwardly together with right-hand ring 41, and its wedge-shaped tooth 42, which movement would again spread the slot 38 and greatly decrease the frictional engagement of the surface 36*b* with the outer surface of the drive shaft 15. As just described with respect to contact from the left by an adjacent carrier 12′, this contact from the right will effect a deeper insertion of both teeth 42 into the slot 38 and may or may not flex left-hand wall 40 slightly, depending upon the dimension of the parts. It will be appreciated that in this embodiment, with no stop such as stop 34, transport of the blind and the carriers 11, 12 along the rail 10 is essential to effect decoupling since one carrier must contact the next to effect the decoupling.

Even when the walls are not as flexible as indicated in the foregoing, the contact from either side will through the contacted wall 40 move the relevant ring 41 with the tooth 42 along the shaft 15. Since the hub 36*a* through friction on the drive shaft 15 tends to stay put, the tooth 42 is forced between the slot edges and spreads the slot sufficiently to effect the required decoupling.

We claim:

1. In a louvered venetian blind having a headrail, a plurality of louver carriers mounted on the headrail for movement therealong, each louver carrier supporting a vertical louver for rotation about its vertical axis and for movement along the headrail, a drive shaft, a worm thread driven by said drive shaft, a gear engaged with and driven by said worm thread for rotating a louver about its vertical axis, the improvement comprising a slip clutch between said drive shaft and said worm thread, said slip clutch including two cooperating friction surfaces, one of said friction surfaces being the outer surface of said shaft, the other of said friction surfaces being the inner surface of a sleeve in frictional engagement about the first said friction surface, said sleeve being slotted over at least a portion of its length in a direction parallel to the axis of said sleeve, and means for reducing the friction between said friction surfaces at a preselected point in the cycle of operation of the blind.

2. A venetian blind in accordance with claim 1, in which said gear has a stop, and in which said means for reducing friction is activated to effect such reduction by engaging said stop.

3. A venetian blind in accordance with claim 1, in which said means for reducing friction is activated to effect such reduction in friction by engagement of its associated louver carrier by another carrier moving axially of said drive shaft.

4. A venetian blind in accordance with either of claim 2 or claim 3, in which said slot extends throughout the length of said sleeve and in which said means reduces the friction between said friction surfaces by widening said slot in the circumferential direction of the sleeve.

5. A venetian blind in accordance with claim 4, in which said sleeve in an area substantially diametrically opposite to said slot has a wall thickness less than the remainder of the wall thickness of said sleeve.

6. A venetian blind in accordance with claim 2, in which the outer surface of the sleeve is eccentric to the axis of the sleeve and a plurality of guide surfaces project outwardly from the sleeve to different heights for compensating for the eccentricity of the outer surface of the sleeve.

7. A venetian blind in accordance with claim 6, in which said guide surfaces extend along the outer surface of said sleeve parallel to the axis of said sleeve over only a part of the length thereof and a spring encircling said sleeve adjacent the ends of said guide strips.

8. A venetian blind in accordance with claim 2, in which said worm thread extends around a hub positioned around said sleeve, said hub having a slot along the length thereof parallel to its axis and in substantial alignment with the slot in said sleeve, and in which said means for reducing friction includes a lug on said sleeve extending through the slot in said hub in a position to engage said stop.

9. A venetian blind in accordance with claim 8, in which said sleeve has a pair of such lugs each positioned to engage said stop upon rotation of said gear.

10. A venetian blind in accordance with claim 9, in which said worm thread extends around said hub but not over said slot in said hub and in which said lugs are each aligned with one end of said worm thread.

11. A venetian blind in accordance with claim 10, in which the slot in said sleeve has two portions, said two portions overlap each other and are offset with respect to each other circumferentially of the sleeve, and said lugs overlap each other circumferentially when viewed from the end of the sleeve.

12. A venetian blind in accordance with claim 3, in which said sleeve is a hub and said worm thread extends around and is integral with said hub.

13. A venetian blind in accordance with claim 12, in which said sleeve has a slot therein extending parallel to the axis of the sleeve, said carrier includes a housing, said worm thread and hub being positioned within said housing, a wedge-shaped cam extending part-way into the slot of said sleeve and positioned between said sleeve and the wall of said housing, said wedge-shaped cam acting to widen the slot in said sleeve upon the housing of said carrier being contacted by an adjacent carrier whereby friction between said friction surfaces is reduced.

14. A venetian blind in accordance with claim 13, in which said wedge-like cam is supported by a ring, said ring being loosely supported about said drive shaft between said sleeve and a wall of said housing.

15. A venetian blind in accordance with claim 14, in which there are a pair of said wedge-like cams each mounted on a ring, each of said rings being mounted loosely on said drive shaft at opposite ends of said sleeve and between said sleeve and an adjacent wall of said housing and said wedge-like cams extending into opposite ends of the slot in said sleeve.

* * * * *